US010195857B1

(12) United States Patent
Praharaj et al.

(10) Patent No.: US 10,195,857 B1
(45) Date of Patent: Feb. 5, 2019

(54) RECOVERY OF MISSING JETS

(71) Applicant: Xerox Corporation, Norwalk, CT (US)

(72) Inventors: Seemit Praharaj, Webster, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/647,318

(22) Filed: Jul. 12, 2017

(51) Int. Cl.
*B41J 2/165* (2006.01)
*B41J 2/21* (2006.01)
*B41J 2/17* (2006.01)

(52) U.S. Cl.
CPC ..... *B41J 2/16526* (2013.01); *B41J 2/1707* (2013.01); *B41J 2/2103* (2013.01)

(58) Field of Classification Search
CPC ... B41J 2/16505; B41J 2/16517; B41J 2/1652
See application file for complete search history.

(56) References Cited

U.S. PATENT DOCUMENTS 4,727,378 A 2/1988 Le et al.
5,455,606 A 10/1995 Keeling et al.
5,793,389 A 8/1998 Mitchell
5,870,126 A 2/1999 Kondo et al.
5,975,689 A 11/1999 Pawlowski, Jr. et al.
6,312,087 B1 11/2001 Imai et al.
6,419,343 B1 * 7/2002 Taylor ..... B41J 2/16526 347/23
6,781,290 B2 8/2004 Kurihara et al.
7,686,433 B2 3/2010 Domoto
2010/0271424 A1 * 10/2010 Cunnington ..... B41J 2/16526 347/33

* cited by examiner

*Primary Examiner* — Juanita D Jackson
(74) *Attorney, Agent, or Firm* — Gibb & Riley, LLC

(57) ABSTRACT

A jet recovery print process is performed each time before printing a print job, when an inactivity period of non-printing has been exceeded, or during a long print job, where the jets might clog with debris. The jet recovery print process ejects the ink from the inkjets by printing (using the inkjets) a sacrificial page in a jet recovery pattern, while operating the actuators in the inkjets at their maximum voltage rating. The jet recovery pattern is designed to purge all the ink from all the inkjets. Thus, in the jet recovery print process, the controller operates the actuators at their maximum voltage rating so as to provide a higher driving force for the ink to be ejected from the inkjets and thereby make the purge process more effective.

20 Claims, 8 Drawing Sheets

RECOVERY OF MISSING JETS

BACKGROUND

Systems and methods herein generally relate to inkjet printers and more particularly to devices and methods for correcting non-operating jets within inkjet printers.

Inkjet printers eject droplets of ink onto print media to perform printing operations. However, when such printers go unused for extended periods of time, the ink can start to dry out potentially causing viscous plugs in the inkjets, or debris can block the nozzles.

In view of this, the inkjet print heads can be cleared of the viscous plug after they are uncapped from an idle state, in order to recover the inkjets in preparation for printing operations. However, while such actions recover a significant number of inkjets, that still leaves large numbers jets missing, and this can adversely affect the print quality. These jets may require several additional purge cycles to recover (wasting a significant amount of ink) and some may not even be recoverable by any amount of such processing.

SUMMARY

Methods herein operate an inkjet printer by automatically activating the controller of the inkjet printer to control the inkjets to perform a jet recovery print process. The jet recovery print process is performed each time before printing a print job, (or during a long printing job) when an inactivity period of non-printing has been exceeded (e.g., each time printing is to occur after the printer has sat idle too long, and the limit for the allowed time between printing activities has expired), or each time the inkjets fail during printing of a print job.

The jet recovery print process ejects the ink from the inkjets, because the, having been in the inkjets longer than the inactivity period. The jet recovery print process ejects the ink from the inkjets by printing (using the inkjets) a sacrificial page in a jet recovery pattern, while operating the actuators (e.g., piezoelectric elements, etc.) in the inkjets at their maximum voltage rating. The jet recovery pattern is designed to eject all the ink from all the inkjets.

The jet recovery print process can also optically scan (using an optical sensor of the inkjet printer) the printing ink on the first sacrificial page to identify non-print locations on the first page, which are locations where the inkjets failed to print the jet recovery pattern. Additionally, this jet recovery print process can calculate (using the controller) which of the inkjets did not print when printing the first page, based on such non-print locations. Then, this jet recovery print process prints (again using the inkjets) one or more second pages having a second pattern, again while operating the actuators in the inkjets at their maximum voltage rating. This second pattern causes only the inkjets that did not print during the printing of the first page to print.

Thus, in the jet recovery print process, the controller operates the actuators at their maximum voltage rating during the printing of the first page (and potentially the second page) so as to provide a higher driving force for the ink to be ejected from the inkjets and make the unclogging process more effective. The maximum voltage rating is distinguished from the operating voltage the ink jet actuators use when printing print jobs, because the operating voltage is lower than the maximum voltage rating of the actuators. For example the operating voltage can be less than approximately 20%, etc., of the maximum voltage rating. Further, operation of the inkjets at a voltage above the maximum voltage rating damages the inkjets. However, the inkjets operate at the same frequency when printing the print jobs and when performing the jet recovery print process. Also, the jet recovery print process ejects the printing ink free of debris.

Inkjet printers herein include (among other components) a media container (capable of holding print media), inkjets (positioned to eject printing ink on the print media), an optical sensor (positioned to optically scan the printing ink on the print media), etc., all electrically connected to a controller. Such devices also include an ink container, capable of holding the printing ink that is connected to the inkjets. Further, passages connect the ink container to the inkjets, and such passages are capable of delivering the printing ink from the ink container to the inkjets.

The inkjets have nozzles aimed at the print media, and actuators (e.g., piezoelectric elements, etc.) positioned to eject the printing ink through the nozzles on to the print media. The actuators operate at an operating voltage (that is lower than a maximum voltage rating of the actuators) when printing print jobs.

When inkjets fail during the printing of a print job (where debris may collect while printing and can jam nozzles), or an inactivity period of non-printing has been exceeded (e.g., each time printing is to occur after the printer has sat idle too long, and the limit for the allowed time between printing activities has expired), the controller automatically operates the inkjets to perform a jet recovery print process. The jet recovery print process prints (using the inkjets) a first page in a jet recovery pattern that ejects the printing ink that has been in the inkjets longer than the inactivity period from the inkjets; and does so while operating the ink jet actuators at their maximum voltage rating.

In addition, the optical sensor can optically scan that first page, such that the printing ink on the first page can be used to identify non-print locations on the first page (locations where the inkjets failed to print the jet recovery pattern). This allows the controller to automatically calculate which of the inkjets did not print during the printing of the first page (based on the non-print locations). Then, the jet recovery print process prints (again, using the inkjets) at least one second page having a second pattern; again, while operating the ink jet actuators at their maximum voltage rating. The second pattern causes only the inkjets that did not print during the printing of the first page to print.

Thus, in the jet recovery print process, the controller operates the actuators at their maximum voltage rating during the printing of the first page (and potentially the second page(s)) so as to provide a higher driving force for the ink to be ejected from the inkjets and make the unclogging process more effective. The maximum voltage rating is distinguished from the operating voltage the ink jet actuators use when printing print jobs, because the print job operating voltage is lower than the maximum voltage rating of the actuators. For example the operating voltage can be less than approximately 20%, etc., of the maximum voltage rating. Further, operation of the inkjets at a voltage above the maximum voltage rating damages the inkjets. However, the inkjets operate at the same frequency when printing the print jobs and when performing the jet recovery print process. Also, the jet recovery print process ejects the printing ink free of debris.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, inkjet print heads can be cleared of the ink after an idle state; however, the inkjets may require several purge cycles to recover (wasting a significant amount of ink) and some may not even be recoverable by any amount of such processing. Therefore, the devices and methods herein perform unclogging by printing a jet recovery image at maximum permissible peak potential of the actuators to get rid of all intermittent missing jets, before reverting to nominal Vpp. This particular startup image can be designed to trigger the high Vpp; and a feedback loop through an image sensor can be used to perform multiple repeats until the number of missing jets falls below a desired threshold.

Figure 1:
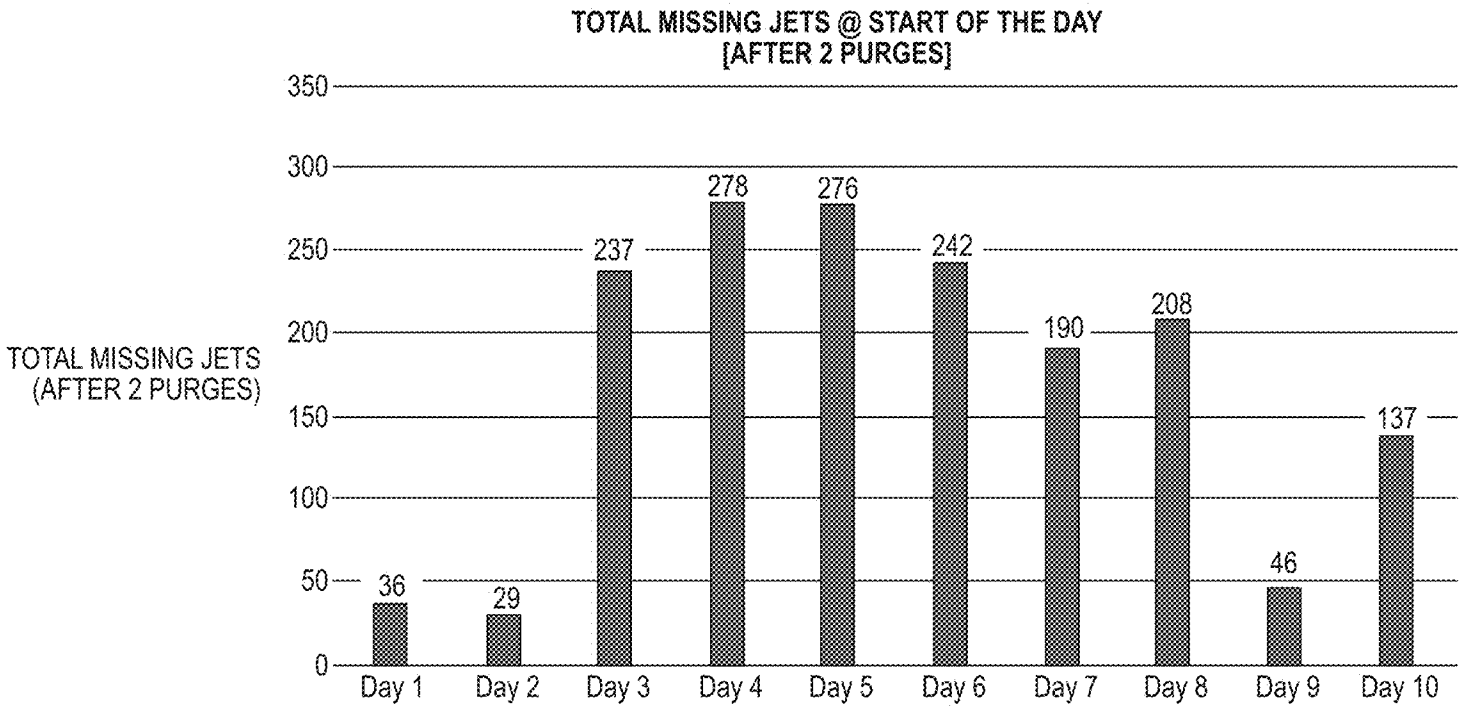
FIGS. 1-3 are charts illustrating operations performed by methods and devices herein.

The presence of missing jets can severely compromise the image quality in prints produced by aqueous inkjet direct-to-paper fixtures. Further, if such jets are not recovered (cleared, etc.) within a very few print cycles, they can become permanently clogged, or otherwise non-functional. Therefore, it is very useful to fix non-functioning inkjets as quickly as possible. For example, the chart shown in FIG. 1 represents the number of missing jets (over four heads, such as cyan, magenta, yellow, and black (CMYK), etc.) after two purge cycles at the start of the day over a period of 10 days. As can be seen, in FIG. 1, on most days the heads start with approximately 200 missing jets.

Figure 2:
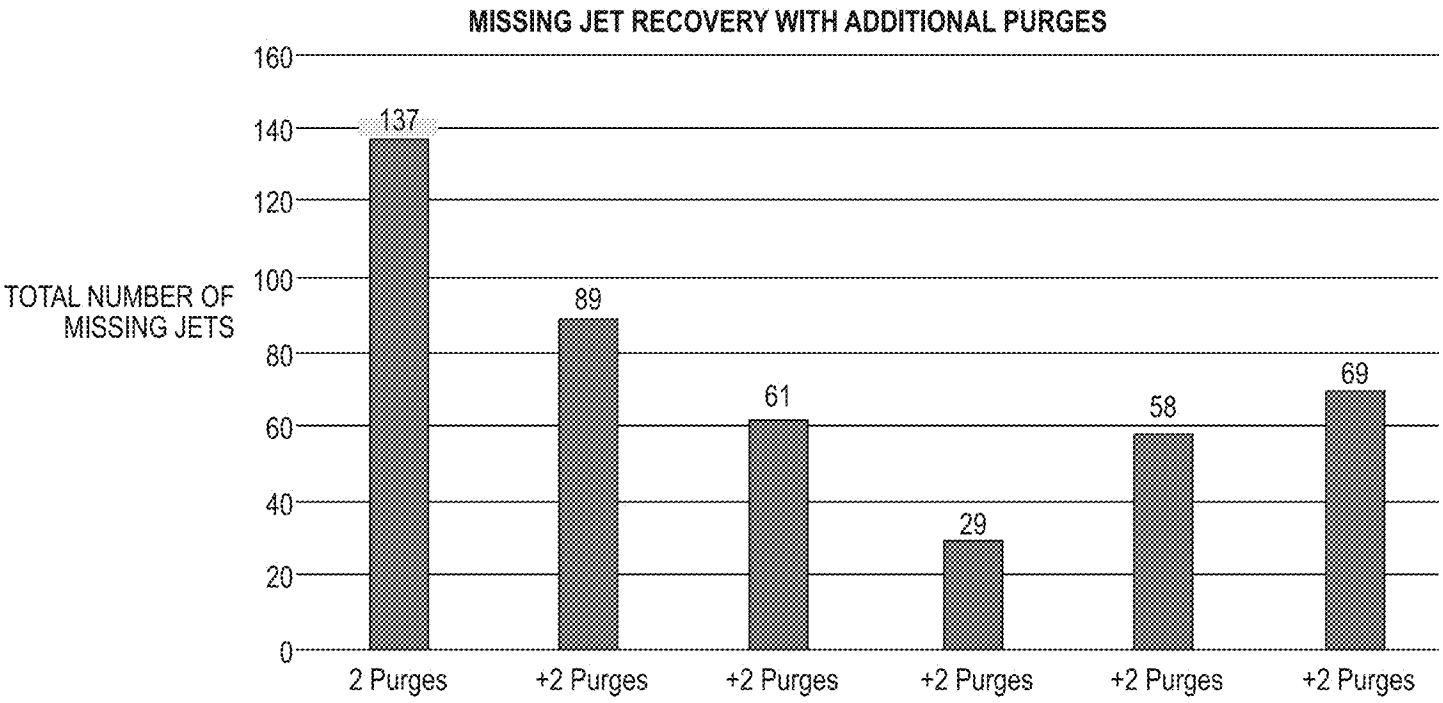

Some of these missing jets shown in FIG. 1 may be recovered by further clearing of the print head, and the plot shown in FIG. 2 represents the variation in missing jets with the number of additional purging processes. As can be seen in FIG. 2, while the additional cycles are able to recover some jets, the resulting number of missing jets is still fairly high. Further purging by itself represents a significant waste of ink (over a period of time). In addition, imperfect wiping techniques (following the purge cycles) may sometimes result in an increased number missing jets.

Figure 3:
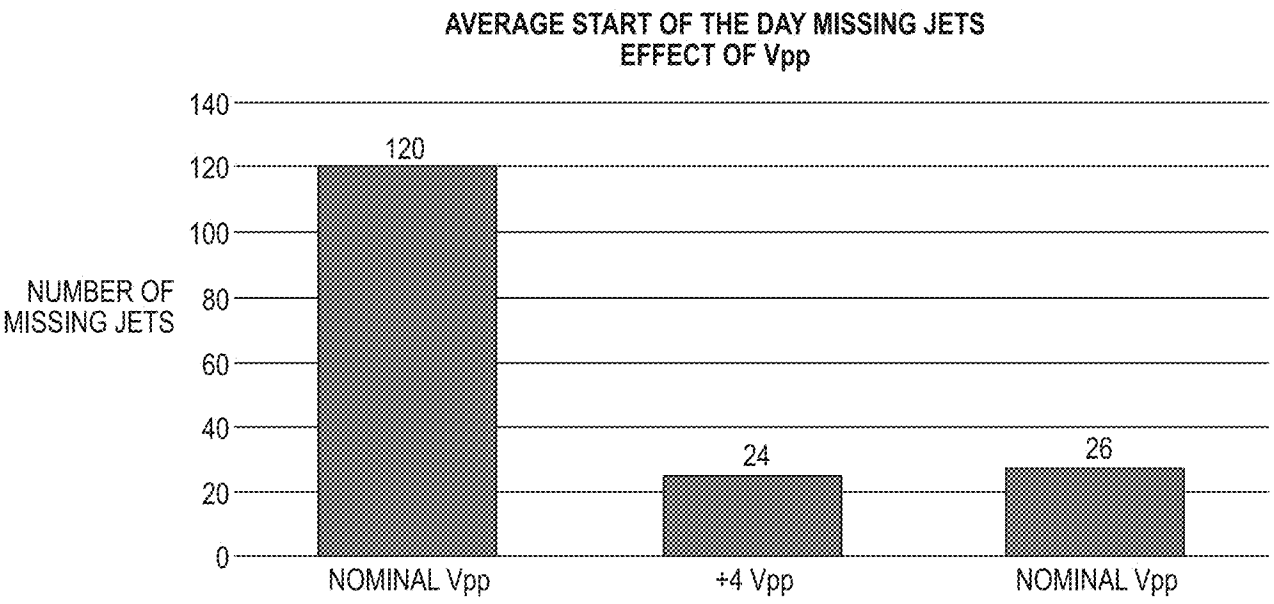

To increase the effectiveness of such processes, the devices and methods herein increase the Vpp (peak potential) applied to the actuators in the inkjets to the maximum permissible Vpp for each color (again, using CMYK in this example), and such brings the number of initial missing jets down substantially, as shown in FIG. 3. For the plot shown in FIG. 3, the cyan voltage was increased by 4 volts at the start of the day. The missing jet routine was printed, and the voltage was lowered down to the nominal voltage. The plot shown in FIG. 3 illustrates the number of missing jets in each of those cases. In one example, intermittent missing jets could be caused by presence of debris as well as viscous plugs. Increasing the peak potential Vpp and printing allows for a higher driving force for the ink to power through those particular nozzles. Once the nozzles are cleared, restoring to the nominal Vpp allows printing with a very low number of missing jets.

Figure 4:
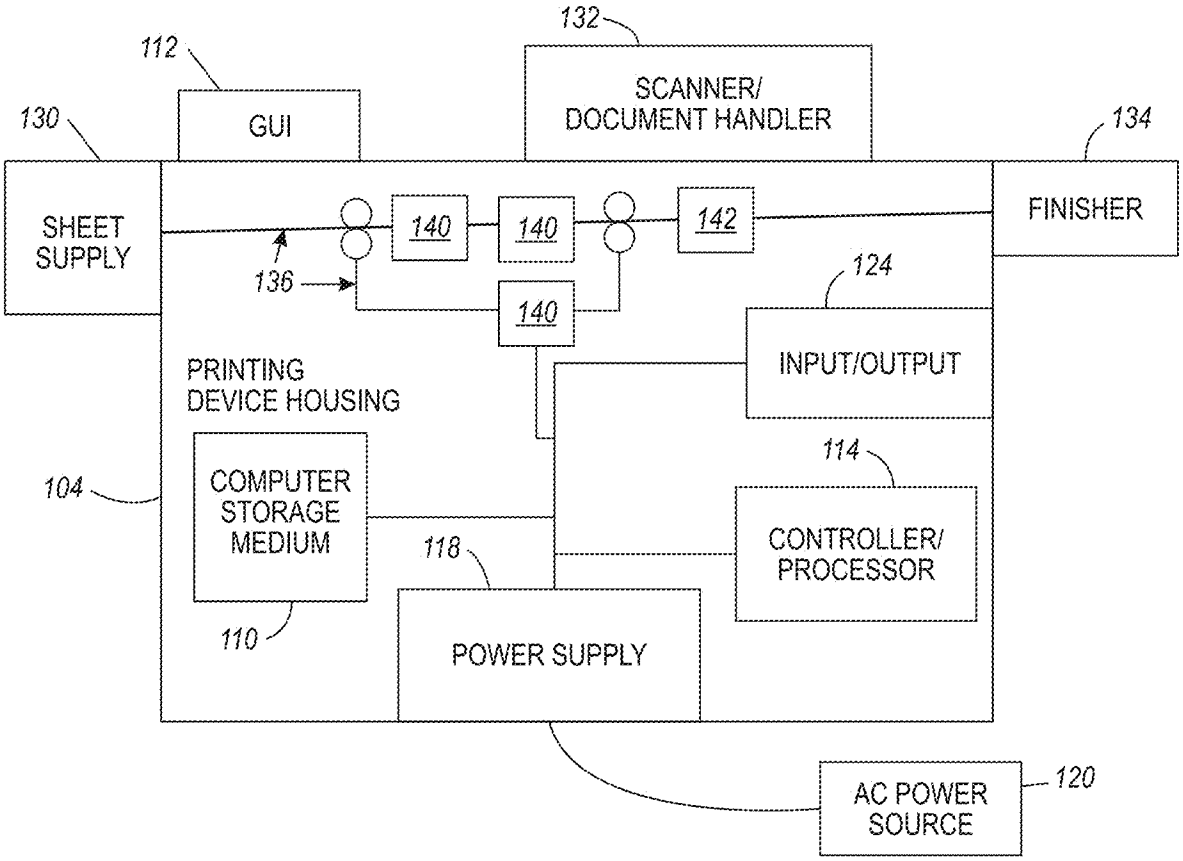
FIG. 4 is a schematic diagram illustrating printing devices herein.

FIG. 4 illustrates many components of printer structures 104 herein that can comprise, for example, a printer, copier, multi-function machine, multi-function device (MFD), etc. The printing device 104 includes a controller/tangible processor 114 and a communications port (input/output) 124 operatively connected to the tangible processor 114 and to a computerized network external to the printing device 104. Also, the printing device 104 can include at least one accessory functional component, such as a graphical user interface (GUI) assembly 112. The user may receive messages, instructions, and menu options from, and enter instructions through, the graphical user interface or control panel 112.

The input/output device 124 is used for communications to and from the printing device 104 and comprises a wired device or wireless device (of any form, whether currently known or developed in the future). The tangible processor 114 controls the various actions of the printing device 104. A non-transitory, tangible, computer storage medium device 110 (which can be optical, magnetic, capacitor based, etc., and is different from a transitory signal) is readable by the tangible processor 114 and stores instructions that the tangible processor 114 executes to allow the computerized device to perform its various functions, such as those described herein. Thus, as shown in FIG. 4, a body housing has one or more functional components that operate on power supplied from an alternating current (AC) source 120 by the power supply 118. The power supply 118 can comprise a common power conversion unit, power storage element (e.g., a battery, etc), etc.

The printing device 104 includes at least one marking device (inkjet printing engine(s)) 140 that use marking material, and are operatively connected to a specialized image processor 114 (that is different from a general purpose computer because it is specialized for processing image data), a media path 136 positioned to supply continuous media or sheets of media from a sheet supply 130 to the marking device(s) 140, etc. After receiving various markings from the printing engine(s) 140, the sheets of media can optionally pass to an internal optical sensor/scanner 142, and a finisher 134 which can fold, staple, sort, etc., the various printed sheets. Also, the printing device 104 can include at least one accessory functional component (such as a scanner/document handler 132 (automatic document feeder (ADF)), etc.) that also operate on the power supplied from the external power source 110 (through the power supply 118).

Figure 5:
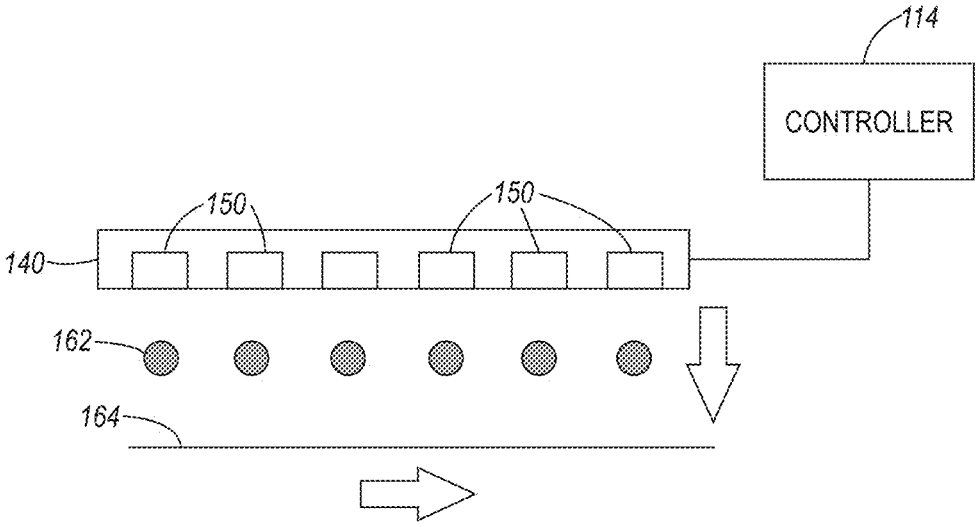
FIG. 5 is a schematic diagram illustrating an inkjet printing engine used by printing devices herein.
Figure 6:
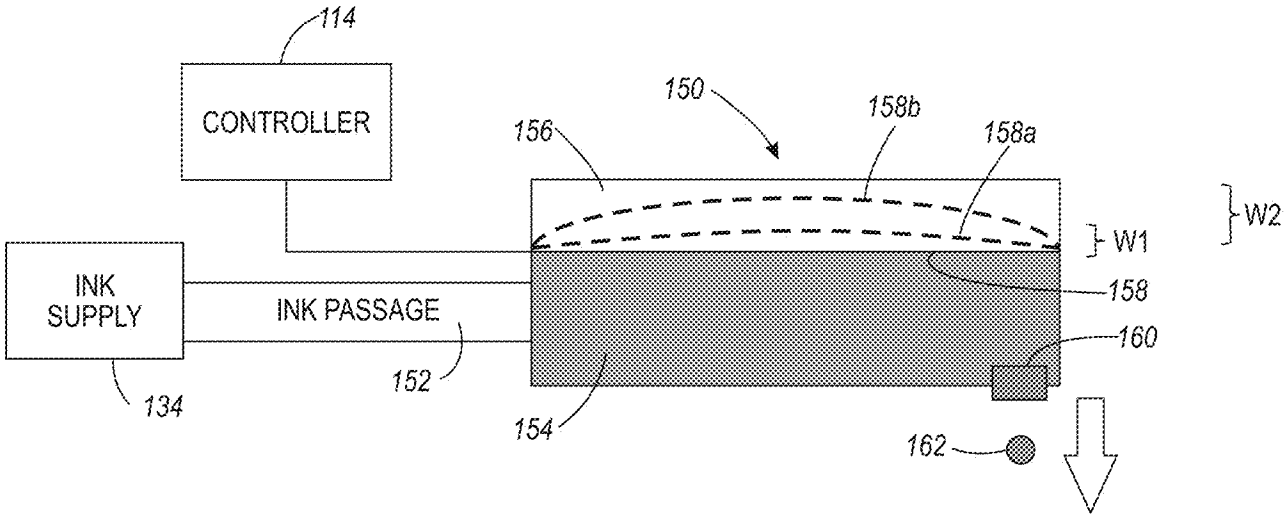
FIG. 6 is a schematic diagram illustrating inkjet devices herein.

As shown in FIG. 5, each of the printing engines 140 (e.g., inkjet printheads 140) can include multiple inkjets 150 positioned in one or more rows, or in an array of inkjets 150 (positioned to eject printing ink droplets 162 on the print media 164). As shown in FIG. 6, each inkjet 150 includes an internal ink container 154, capable of holding the printing ink. Further, ink passages 152 connect the external ink container 134 to the inkjets 150, and such ink passages 152 are capable of delivering the printing ink from the ink container 134 to the inkjets 150.

As shown in FIG. 6, the controller 114 is uniquely designed to control an actuator 158 of the inkjet 150 when performing a jet recovery print process. The actuator 158 can be any element (e.g., piezoelectric element, etc.) that moves in response to the application of voltage from the controller 114. In operation, when the operating voltage used when printing print jobs is applied to the actuator 158, the actuator 158 moves into an air gap 156 as shown by dashed line **158*a*, and this draws additional amounts of ink into the internal ink container 154. When the voltage to the actuator 158 is stopped, the actuator snaps back to the position shown in the drawing as 158, increasing the pressure within the internal ink container 154, which causes a droplet of ink 162 to be ejected from a nozzle 160 (which is an opening in the internal ink container 154). One issue relates to the amount of voltage that the controller 114 can apply to the actuator 158, because if too much voltage is applied, the actuator 158** can be damaged.

Other configurations of inkjets 150 are known, and the unique controller 114 and processing described herein are applicable to all inkjet designs, whether currently known or developed in the future (and the inkjet illustrated in FIGS. 5 and 6 is intended to illustrate all such known inkjet structures). The one or more inkjet printing engines 140 shown in the drawings are intended to illustrate any inkjet-type marking device that applies any form of jettable marking material (e.g., liquid inks, molten wax inks, plastics, organic material, etc.) to continuous media, sheets of media, fixed platforms, etc., in two- or three-dimensional printing processes, whether currently known or developed in the future.

Thus, as shown in FIG. 4-6, the inkjets 150 have nozzles 160 aimed at the print media 164 as the print media moves past the inkjets (or vice versa), and the actuators 158 are positioned to eject the printing ink 162 through the nozzles 160 on to the print media 164. The actuators 158 operate at an operating voltage (that is lower than a maximum voltage rating of the actuators 158) when printing print jobs.

When inkjets fail during printing of a print job, or when an inactivity period of non-printing has been exceeded (e.g., each time printing is to occur after the printer has sat idle too long, and the limit for the allowed time between printing activities has expired), the controller 114 automatically operates the inkjets 150 to perform a jet recovery print process. The jet recovery print process prints (using the inkjets 150) a first sacrificial page in a jet recovery pattern that ejects the printing ink that has been in the inkjets 150 longer than the inactivity period from the inkjets 150; and does so while operating the ink jet actuators 158 at their maximum voltage rating, which causes the actuator 158 to move the most it can without being damaged, and such movement is shown using curved line 158*b* in FIG. 6. Note that the additional voltage used in the jet recovery print processing causes the actuator 158 to move more (W2) relative to application of operating voltage that is used during normal printing of print jobs (W1).

The maximum voltage rating is distinguished from the normal operating voltage the ink jet actuators 158 use when printing print jobs, because the normal operating voltage is lower than the maximum voltage rating of the actuators 158. For example the operating voltage can be less than approximately 20%, etc., of the maximum voltage rating. Stated differently, the maximum voltage rating can be, etc., the operating voltage causing actuator 158 to move more (158*b*) relative to normal operating voltage (158*a*).

The jet recovery pattern printed on the sacrificial sheets is also specially designed to move the most ink through the nozzle for each color. Therefore, each color will be printed at a maximum darkness, and at a large enough area of the sheet 164 that has been determined by empirical testing to be sufficient to cause all of the ink to exit the inkjet, and/or sufficient to unclog a predetermined percentage (e.g., above 90%, 95%, 98%, etc.) of the clogged inkjets. Yet, the jet recovery pattern balances the ink usage with such unclogging benefits to only use a sufficient amount of ink to attain the foregoing percentages, without using more, to conserve ink usage.

In addition, an external or internal optical sensor 132/142 can manually or automatically optically scan the previously printed sacrificial page, such that the printing ink on the first page can be used to identify non-print locations on the first page (locations where the inkjets 150 failed to print the jet recovery pattern). This allows the controller to automatically calculate which of the inkjets 150 did not print during the printing of the first page (based on the non-print locations). Then, the jet recovery print process prints (again, using the inkjets 150) a second page having a second pattern; again, while operating the ink jet actuators 158 at their maximum voltage rating. The second pattern causes only the inkjets 150 that did not print during the printing of the first page to print.

Thus, in the jet recovery print process, the controller 114 operates the actuators 158 at their maximum voltage rating during the printing of the first page (and potentially the second page) so as to provide a higher driving force for the ink to be ejected from the inkjets 150 and make the unclogging process more effective. Further, operation of the inkjets 150 at a voltage above the maximum voltage rating damages the inkjets 150. However, the inkjets 150 operate at the same frequency when printing the print jobs and when performing the jet recovery print process. Also, the jet recovery print process ejects the printing ink free of debris.

Figure 7:
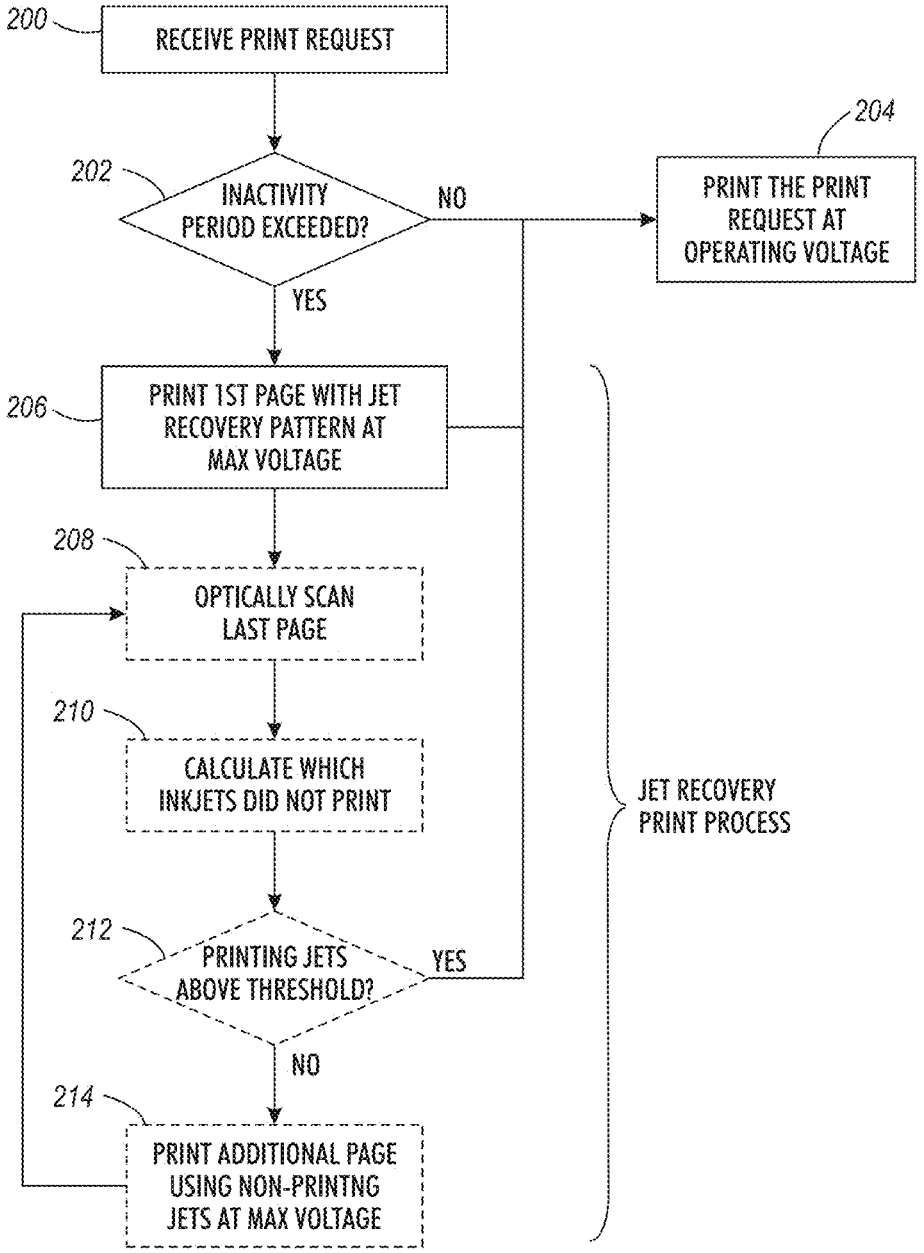
FIGS. 7 and 8 are flow diagrams illustrating various methods herein.

FIG. 7 is flowchart illustrating exemplary methods herein that operate an inkjet printer by automatically activating the controller of the inkjet printer to control the inkjets of the printer to perform a jet recovery print process. More specifically, in item 200 a printing request (containing a print job) is received.

The jet recovery print process is performed each time before printing a print job, when an inactivity period of non-printing has been exceeded (e.g., each time printing is to occur after the printer has sat idle too long, and the limit for the allowed time between printing activities has expired). Therefore, item 202 is a decision box to check whether the inactivity period has been exceeded; and, if it has not, processing proceeds to item 204, where the print job is printed while operating the actuators in the inkjets at their standard operating voltage rating.

However, when the inactivity period of non-printing has been exceeded in item 202, the jet recovery print process ejects the ink from the inkjets, because the ink has been in the inkjets longer than the inactivity period. The jet recovery print process ejects the ink from the inkjets by printing (using the inkjets) a sacrificial page in an initial jet recovery pattern, while operating the actuators (e.g., piezoelectric elements, etc.) in the inkjets at their maximum voltage rating in item 206.

As noted above, the jet recovery pattern used in item 206 is designed to eject all the printing ink from all the inkjets, where each color is printed at a maximum darkness, and on a large enough area of the sheet to be sufficient to cause all of the ink to exit the inkjet, and sufficient to unclog a predetermined percentage of the clogged inkjets.

Processing can proceed directly from item 206 to item 204, or alternatively additional purge cycles can be used, as shown in items 208-214 (which are illustrated using dashed lines, to indicate optional processing). Initially, in item 208, this optional jet recovery print processing optically scans (using an optical sensor of the inkjet printer) the printing ink on the last (most recent) sacrificial page printed to identify non-print locations on that page, which are locations where the inkjets failed to print the jet recovery pattern. Next, this processing optionally calculates (using the controller) which of the inkjets did not print when printing the last page, based on such non-print locations, in item 210.

In item 212, this optional processing looks to see whether percentage of jets that printed is above a threshold; or, stated differently, whether the percentage of non-printing inkjets is below a threshold (e.g., below a number of inkjets (e.g., 100, 60, 40, etc.); or below a percentage of inkjets (e.g., 10%, 5%, 2%, etc.)). The threshold is the number of jets, or percentage of jets is established in advance.

If the non-printing inkjets are below the threshold, no additional purge cycles are necessary, and instead of looping through items 208-214, processing proceeds directly to item 204 to print the print request. Otherwise, if the optional purge cycle processing is to be used, and the percentage of non-printing inkjets is not yet below the threshold, the loop of items 208-214 is performed until the percentage of non-printing inkjets is below the threshold. Additionally, decision box 212 can limit the number of times processing can loop through items 208-214, to prevent infinite loop situations.

Therefore, if the percentage of non-printing inkjets is not yet below the threshold, this jet recovery print process optionally prints (again using the inkjets) another page having a different pattern from the eject pattern, that uses only the non-printing jets, again while operating the actuators in the inkjets at their maximum voltage rating, in item 214. This second pattern used in item 214 activates only the inkjets that did not previously print as determined in item 210, thereby saving substantial amounts of ink in the additional jet recovery print processing processes.

Thus, during the printing 206, 214 in the jet recovery print process, the controller operates the actuators at their maximum voltage rating so as to provide a higher driving force for the ink to be ejected from the inkjets and make the purge process more effective. This maximum voltage rating is distinguished from the operating voltage the ink jet actuators use when printing print jobs in item 204, because the operating voltage is lower than the maximum voltage rating of the actuators when printing print jobs in item 204. For example the operating voltage used in item 204 can be less than approximately 20%, etc., of the maximum voltage rating used in items 206 and 214. Further, the inkjets operate at the same frequency when printing the print jobs in item 204, and when performing the jet recovery print process in items 206 and 214.

Figure 8:
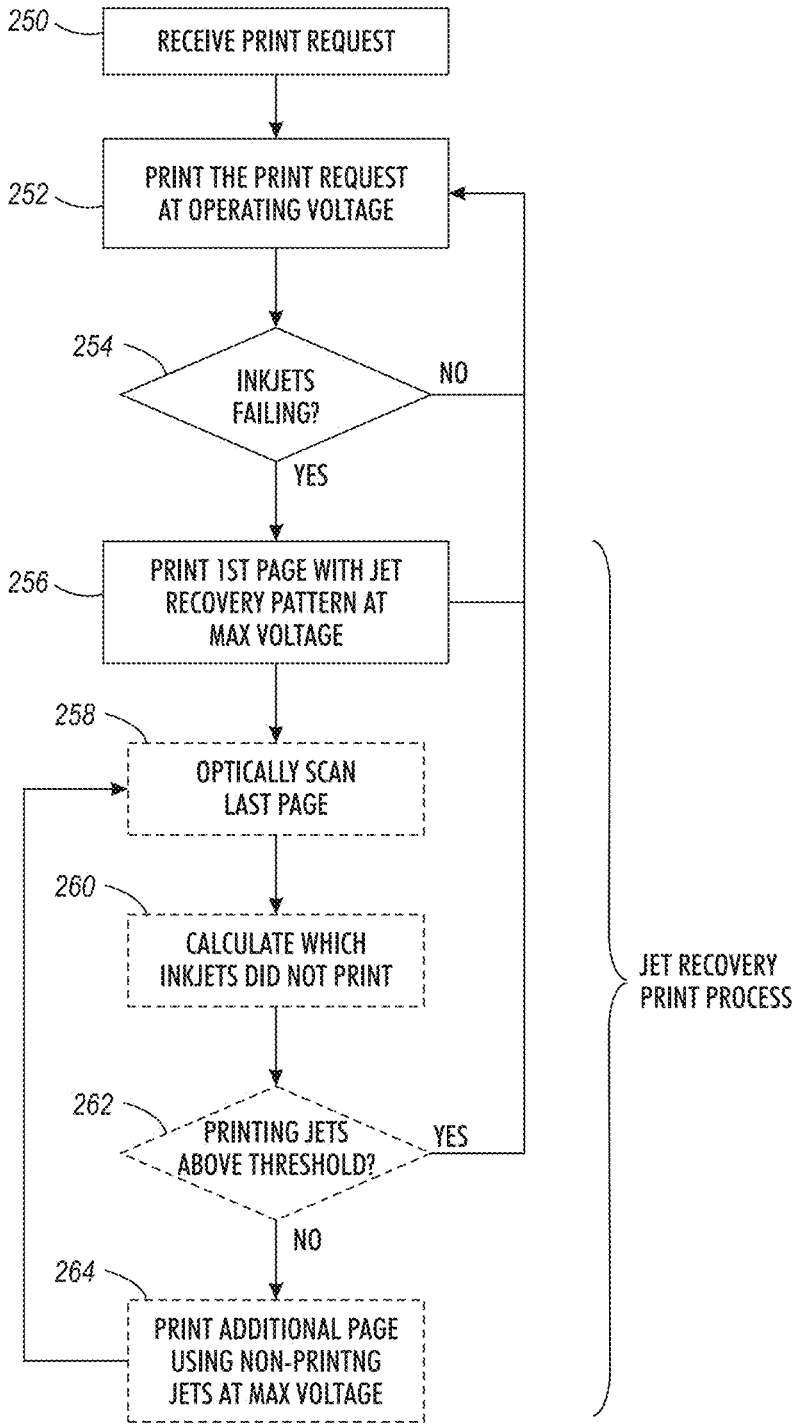

FIG. 8 is flowchart illustrating exemplary methods herein that operate an inkjet printer by automatically activating the controller of the inkjet printer to control the inkjets of the printer to perform a jet recovery print process. More specifically, in item 250 a printing request (containing a print job) is received, and in item 252 the print job is printed while operating the actuators in the inkjets at their standard operating voltage rating.

Item 254 is a decision box to check whether white streaks are occurring at a sufficient rate during the printing of the print job in item 252 (which indicates that some of the inkjets are clogged or are failing) to warrant invocation of the jet recovery print process. For example, a limit for the number and/or size of white streaks can be established, and if this limit is exceeded, decision box 254 directs that the jet recovery print process be executed. Therefore, if the inkjets are not failing (white streaks are not present, or are only minimally present) processing returns to item 252, where the print job is printed, while operating the actuators in the inkjets at their standard operating voltage rating.

However, if the inkjets are failing in item 254, the jet recovery print process ejects the ink from the inkjets by printing (using the inkjets) a sacrificial page in an initial jet recovery pattern, while operating the actuators (e.g., piezoelectric elements, etc.) in the inkjets at their maximum voltage rating in item 256. The printing in item 256 interrupts the print job being printed in item 252, to print the sacrificial page. After printing in item 256, the sacrificial page is directed to a different output from the output being used for the print job, so that it will not be included with the print job output. For example, the sacrificial page can be directed to a trash or disposal output (after any needed scanning or inspection, etc.).

As noted above, the jet recovery pattern used in item 256 is designed to eject all the printing ink from all the inkjets, where each color is printed at a maximum darkness, and on a large enough area of the sheet to be sufficient to cause all of the ink to exit the inkjet, and sufficient to unclog a predetermined percentage of the clogged inkjets.

Processing can proceed directly from item 256 back to item 252, or alternatively additional purge cycles can be used, as shown in items 258-264 (which are illustrated using dashed lines, to indicate optional processing). Initially, in item 258, this optional jet recovery print processing optically scans (using an optical sensor of the inkjet printer) the printing ink on the last (most recent) sacrificial page printed to identify non-print locations on that page, which are locations where the inkjets failed to print the jet recovery pattern. Next, this processing optionally calculates (using the controller) which of the inkjets did not print when printing the last page, based on such non-print locations, in item 260. Similar to the processing discussed above, in item 262, this optional processing looks to see whether percentage of jets that printed is above a threshold.

If the non-printing inkjets are below the threshold, no additional purge cycles are necessary, and instead of looping through items 258-264, processing proceeds directly to item 252 to continue printing the print request. Otherwise, if the optional purge cycle processing is to be used, and the percentage of non-printing inkjets is not yet below the threshold, the loop of items 258-264 is performed until the percentage of non-printing inkjets is below the threshold. Additionally, decision box 262 can limit the number of times processing can loop through items 258-264, to prevent infinite loop situations.

Therefore, if the percentage of non-printing inkjets is not yet below the threshold, this jet recovery print process optionally prints (again using the inkjets) another page having a different pattern from the eject pattern, that uses only the non-printing jets, again while operating the actuators in the inkjets at their maximum voltage rating, in item 264. This second pattern used in item 264 activates only the inkjets that did not previously print as determined in item 260, thereby saving substantial amounts of ink in the additional jet recovery print processing processes.

Thus, during the printing 256, 264 in the jet recovery print process, the controller operates the actuators at their maximum voltage rating so as to provide a higher driving force for the ink to be ejected from the inkjets and make the purge process more effective. This maximum voltage rating is distinguished from the operating voltage the ink jet actuators use when printing print jobs in item 252, because the operating voltage is lower than the maximum voltage rating of the actuators when printing print jobs in item 252.

As noted above, the devices and methods herein solve many highly complex technological problems. For example, as mentioned above, a technical problem with inkjet printers is that ink can result in the presence of debris as well as viscous plugs in the inkjets, preventing the inkjets from ejecting ink droplets. Further, merely repeating the purge process, and can waste ink. The devices and methods herein solve this technological problem by applying much higher voltages to the actuators during each jet recovery process, and by using a unique jet recovery pattern, which combine to provide a greater driving force to the ink to more effectively eject the ink. This unclogs more inkjets when compared to jet recovery print processing at standard operating voltages, and also saves ink by reducing the number of purge cycles (potentially to just one). Additionally, when additional purge cycles are used, such printing is limited to only the inkjets that did not previously print, thereby saving substantial amounts of ink in the additional jet recovery process.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An inkjet printer comprising:
- a controller;
- a media container electrically connected to said controller, said media container is capable of holding print media; and
- inkjets electrically connected to said controller, said inkjets are positioned to eject printing ink on said print media;
- said inkjets comprising:
  - nozzles aimed at said print media; and
  - actuators positioned to eject said printing ink through said nozzles on to said print media,
- said actuators operate at an operating voltage when printing print jobs,
- said operating voltage is lower than a maximum voltage rating of said actuators,
- said controller automatically operates said inkjets to perform a jet recovery print process each time before printing a print job, when an inactivity period of non-printing has been exceeded,
- said jet recovery print process has a jet recovery pattern that ejects said printing ink that has been in said inkjets longer than said inactivity period from said inkjets, and
- said controller operates said actuators at said maximum voltage rating during said jet recovery print process.

2. The inkjet printer according to claim 1, said controller automatically operates said inkjets to perform a jet recovery print process each time said inkjets fail during printing of a print job.

3. The inkjet printer according to claim 1, operation of said inkjets at a voltage above said maximum voltage rating damages said inkjets.

4. The inkjet printer according to claim 1, said inkjets operate at the same frequency when printing said print jobs and when performing said jet recovery print process.

5. The inkjet printer according to claim 1, said jet recovery print process ejects said printing ink free of debris.

6. The inkjet printer according to claim 1, said actuators comprise piezoelectric elements.

7. The inkjet printer according to claim 1, further comprising:
- an ink container, capable of holding said printing ink, connected to said inkjets; and
- passages connecting said ink container to said inkjets,
- said passages are capable of delivering said printing ink from said ink container to said inkjets.

8. An inkjet printer comprising:
- a controller;
- a media container electrically connected to said controller, said media container is capable of holding print media;
- inkjets electrically connected to said controller, said inkjets are positioned to eject printing ink on said print media; and
- an optical sensor connected to said controller, said optical sensor is positioned to optically scan said printing ink on said print media,
- said inkjets comprising:
  - nozzles aimed at said print media; and actuators positioned to eject said printing ink through said nozzles on to said print media, said actuators operate at an operating voltage when printing print jobs, said operating voltage is lower than a maximum voltage rating of said actuators, said controller automatically operates said inkjets to perform a jet recovery print process each time before printing a print job, when an inactivity period of non-printing has been exceeded, said jet recovery print process comprises:

printing, by said inkjets, a first page in a jet recovery pattern that ejects said printing ink that has been in said inkjets longer than said inactivity period from said inkjets;

optically scanning, by said optical sensor, said printing ink on said first page to identify non-print locations on said first page where said inkjets failed to print said jet recovery pattern;

calculating, by said controller, which of said inkjets did not print during said printing of said first page, based on said non-print locations; and printing, by said inkjets, a second page having a second pattern that causes only said inkjets that did not print during said printing of said first page to print, and said controller operates said actuators at said maximum voltage rating during said printing of said first page and said second page.

9. The inkjet printer according to claim 8, said controller automatically operates said inkjets to perform a jet recovery print process each time said inkjets fail during printing of a print job.

10. The inkjet printer according to claim 8, operation of said inkjets at a voltage above said maximum voltage rating damages said inkjets.

11. The inkjet printer according to claim 8, said inkjets operate at the same frequency when printing said print jobs and when performing said jet recovery print process.

12. The inkjet printer according to claim 8, said jet recovery print process ejects said printing ink free of debris.

13. The inkjet printer according to claim 8, said actuators comprise piezoelectric elements.

14. The inkjet printer according to claim 8, further comprising:

an ink container, capable of holding said printing ink, connected to said inkjets; and passages connecting said ink container to said inkjets, said passages are capable of delivering said printing ink from said ink container to said inkjets.

15. A method of operating an inkjet printer comprising:

automatically operating a controller of said inkjet printer to control inkjets of said printer to perform a jet recovery print process each time before printing a print job, when an inactivity period of non-printing has been exceeded, said jet recovery print process comprises:

printing, by said inkjets, a first page in a jet recovery pattern that ejects printing ink that has been in said inkjets longer than said inactivity period from said inkjets;

optically scanning, by an optical sensor of said inkjet printer, said printing ink on said first page to identify non-print locations on said first page where said inkjets failed to print said jet recovery pattern;

calculating, by said controller, which of said inkjets did not print during said printing of said first page, based on said non-print locations; and printing, by said inkjets, a second page having a second pattern that causes only said inkjets that did not print during said printing of said first page to print, said controller operates actuators of said inkjets at a maximum voltage rating during said printing of said first page and said second page, said actuators operate at an operating voltage when printing print jobs, and said operating voltage is lower than said maximum voltage rating of said actuators.

16. The method of operating an inkjet printer according to claim 15, said controller automatically operates said inkjets to perform a jet recovery print process each time said inkjets fail during printing of a print job.

17. The method of operating an inkjet printer according to claim 15, operation of said inkjets at a voltage above said maximum voltage rating damages said inkjets.

18. The method of operating an inkjet printer according to claim 15, said inkjets operate at the same frequency when printing said print jobs and when performing said jet recovery print process.

19. The method of operating an inkjet printer according to claim 15, said jet recovery print process ejects said printing ink free of debris.

20. The method of operating an inkjet printer according to claim 15, said actuators comprise piezoelectric elements.

* * * * *